US009961953B1

(12) United States Patent
VanHoutin et al.

(10) Patent No.: US 9,961,953 B1
(45) Date of Patent: May 8, 2018

(54) HELMET FACEGUARD RETAINING DEVICE

(71) Applicant: KRANOS IP CORPORATION, Litchfield, IL (US)

(72) Inventors: Louis Anthony VanHoutin, Iuka, IL (US); Cortney Anthony Warmouth, Edwardsville, IL (US); Vincent R. Long, St. Peters, MO (US)

(73) Assignee: KRANOS IP CORPORATION, Litchfield, IL (US)

( * ) Notice: Subject to any disclaimer, the term of this patent is extended or adjusted under 35 U.S.C. 154(b) by 0 days. days.

(21) Appl. No.: 15/380,508

(22) Filed: Dec. 15, 2016

(51) Int. Cl.
*A42B 3/32* (2006.01)
*A42B 3/20* (2006.01)

(52) U.S. Cl.
CPC ..... *A42B 3/328* (2013.01); *A42B 3/20* (2013.01)

(58) Field of Classification Search
CPC ..... A42B 3/328; A42B 3/20; A44B 99/00; Y10T 24/44427; Y10T 24/4453; Y10T 24/44752; Y10T 24/1498; A63B 71/10; F16L 3/1236
See application file for complete search history.

(56) References Cited

U.S. PATENT DOCUMENTS 4,220,301 A * 9/1980 Jacobs ..... A42B 3/20 2/9
4,363,140 A * 12/1982 Correale ..... A42B 3/20 2/424
4,701,983 A * 10/1987 Warmath ..... A47G 25/485 223/91
5,402,558 A * 4/1995 Santapa ..... A47G 25/485 223/91
6,199,219 B1 * 3/2001 Silken ..... A42B 3/20 2/424
8,756,771 B1 * 6/2014 Moreau ..... F16B 2/10 24/517
9,265,297 B2 2/2016 Warmouth et al.
2010/0251464 A1 10/2010 Parisi
2012/0011686 A1 1/2012 Duong
2016/0021968 A1 * 1/2016 Warmouth ..... A42B 3/328 24/517

* cited by examiner

*Primary Examiner* — Robert Sandy
*Assistant Examiner* — Rowland Do
(74) *Attorney, Agent, or Firm* — Notaro, Michalos & Zaccaria P.C.

(57) ABSTRACT

A faceguard retaining device has a base with underlying portion extending along a surface of a helmet shell. A latch, pivotally mounted to the base, has a hooked part, a pair of nubs and a pair of trunnions, the nibs and trunnions being in grooves of the base when the latch is in a closed and locked condition to prevent the latch from opening. A clip engaged to the latch and base biases the latch closed. A stabilizer is in a stabilizer groove of the base and a plate extends over the underlying portion. A fastener fastens the plate and base to the shell to resists bending of the underlying portion. The latch is lifted from the underlying portion to lift the nubs from the grooves and allow the latch to pivot upwardly into an open condition.

20 Claims, 5 Drawing Sheets

HELMET FACEGUARD RETAINING DEVICE

FIELD AND BACKGROUND OF THE INVENTION

Field of the Invention

The present invention relates generally to the field of protective helmets, and in particular, to a new and useful device for releasable attachment of a faceguard to a helmet shell.

Background of the Invention

In many sports, it is desirable for participants to wear a helmet to protect against head injury as a result of collisions. This is particularly the case in youth sports. It may also be desirable to protect the face by providing a generally cage-like faceguard across the front of the helmet shell. This provides frontal protection while retaining substantial frontal visibility. Such combinations of helmet shells and faceguards may be used in a number of sports, including football, lacrosse, baseball, fast-pitch softball, hockey, and the like.

In the event of injury, the faceguard may impede the ability of medical personnel to render assistance, as they will be unable to directly access the injured player's face to conduct tests and render treatment with the helmet shell and faceguard in place. The presence of a faceguard may also make it difficult to administer emergency aid such as, for example, mouth-to-mouth resuscitation. While access to the player's face may be achieved by removing the entire helmet shell with the faceguard attached, such removal may be undesirable in the event of a suspected brain or spinal injury. When such injuries are suspected, the general recommendation is to minimize head and neck movement. To avoid moving the player's head under such conditions, it may be necessary to remove the faceguard from the helmet shell prior to administering treatment. Such removal, however, tends to be relatively time-consuming and, in an emergency situation, complex. Thus, there is a need for a faceguard attachment system which permits rapid removal of the faceguard without requiring removal of the entire helmet.

Patent publication US2012/0011686 by Duong attempts to address these issues by teaching clips for securing a face mask to an article of head gear, and for releasing the face mask without the need for any special tools or equipment. The reference teaches that the clip may comprise a base and a retaining member that is pivotably coupled to the base. When the retaining member is engaged with the base, structure on the base prevents the retaining member from pivoting open, thus securing the face mask within the clip. To disengage the retaining member and release the face mask from the clip, a user may squeeze or flex a portion of the base, which causes the retaining member to disengage and pivot open.

Among other things, the reference fails to teach a shock stabilizer, or any other piece made of a material softer than the base or retaining member. Thus, upon impact there is no "give" in the device and such is important for allowing for effective absorption of impact.

Patent publication US2010/0251464 by Parisi also attempts to address the problem. This reference teaches an attachment system for operative connection of a faceguard to a helmet shell with the faceguard being held within a selectively releasable clamp operatively secured to the helmet shell. The attachment system includes a compressible spring clip held in overlying relation to the helmet shell. The spring clip is adapted to selectively clamp a bridge member of the faceguard. A selectively engageable latch structure holds the spring clip in the closed condition. Upon release of the latch structure, the spring clip is urged to the open condition, such that the faceguard may be rotated away from a user's face.

This device relies on a locking-arm-and-latch structure. The locking arm includes an angled head having a half arrowhead profile adapted for receipt through an acceptance slot. Impact of sufficient force can cause the locking arm to break and/or fail. The reliance on this structure, thus, presents a significant safety issue, as the faceguard may then fall off during play.

U.S. Pat. No. 9,265,297 to the present applicant, granted Feb. 23, 2016 and incorporated herein by reference, discloses a faceguard retaining device that solves many problems of earlier approaches and of the widely used plastic loop straps that had to be cut to quickly remove a faceguard from an injured player, in particular, a football player. The present invention improves on this theme to further advance the field of helmet design, in particular, for a faceguard securing device which provides optimal securement of the faceguard to the helmet, but which can quickly and easily be released.

SUMMARY OF THE INVENTION

Accordingly, one of the various objects of the invention is to provide a device for effectively securing a faceguard to a helmet.

It is also an object of the present invention to provide a device which allows for quick removal of the faceguard from the helmet.

The present invention is a quick-release faceguard retaining device having a cooperating base and a latch.

The base has an overlying portion and an underlying portion. It has an opening in the underlying portion for connecting the device to a helmet by, for example, a screw and T-nut of know design.

There is a grommet located in the opening of the base, the grommet defining a grommet opening. There is, in typical embodiments, a spacer located in the grommet opening. The grommet is typically a shock-absorbing disc. The shock-absorbing disc has a platform base and a raised surface. The raised surface is typically composed of two opposed crescents arranged to accommodate a curvature of the spacer. The grommet is, in certain embodiments, made of SURLYN.

The device also has a shock stabilizer located in a shock stabilizer-receiving groove of the base. The shock stabilizer is of a softer material than the base. For example, the shock stabilizer maybe made of rubber, and the base made from a thermoplastic polymer, such as a hard polycarbonate.

The latch is connected to the base in a hinged manner, and has a hooked part at one end.

The base, shock stabilizer and latch together define a receiving aperture in a closed condition for securing a faceguard wire in the device.

The device also has a clip disposed in between the base and the latch. The clip has curved parts at a first end and at a second end. The clip is secured within a clip-receiving part of the base at the first end and within a clip-receiving part of the latch at the second end. The clip exerts closing forces on the latch and the base, so that, overall, the retaining device is biased to a closed condition.

For added security, the present quick release retaining device has a locking mechanism to keep the latch down on the base in ots closed condition. This mechanism is in the form of, for example, ears or nubs that extend laterally from the sides of the latch and sit near the tops of a pair of grooves in the base that also receive pivot trunnions of the latch for pivotally mounting the latch to the base. With the ears in the groove, such pivotal motion is prevented. This locks the latch in its down and latched position, positively holding the faceguard wire to the helmet. To unlock the latch, the latch is lifted vertically from the base, allowing the ears or nubs to rise out of the groove and thereafter allowing the latch to pivot back into its open position to release the faceguard wire.

The retaining device of the invention also includes a spring steel plate that lies over the base and is held in place by the screw that also fixes the base to the helmet, in order to positively hold the retainer against the helmet surface and avoid permanent bending of the base away from the helmet surface. Such bending may occur, for example, when the faceguard is forcefully pulled forwardly of the helmet during a play.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
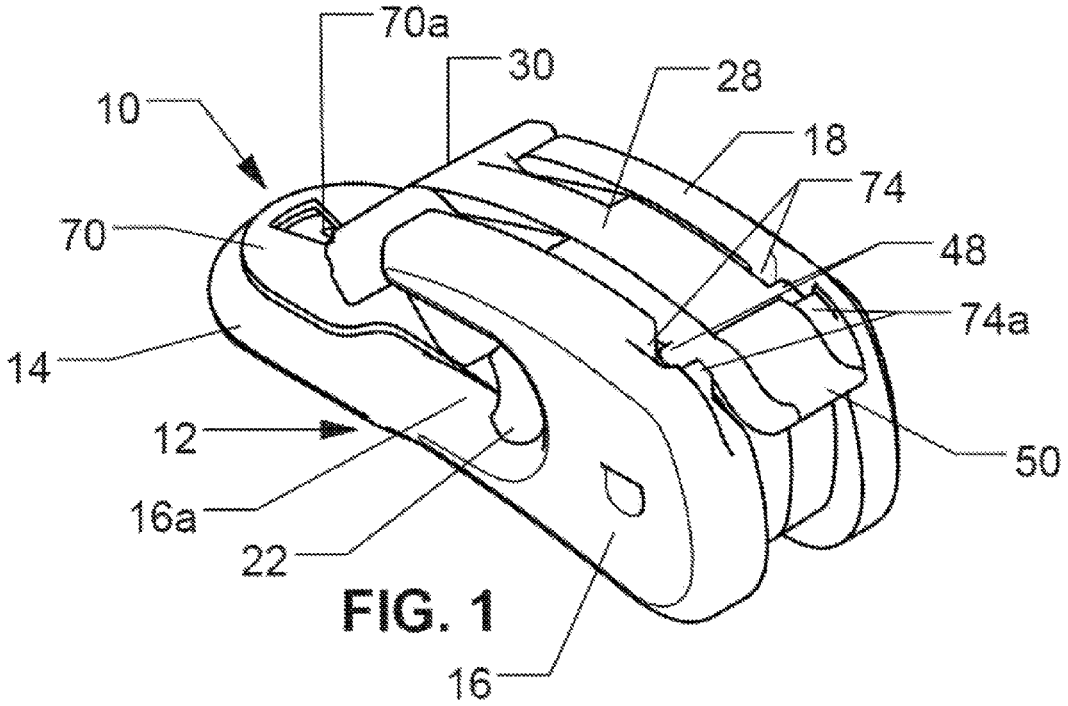
FIG. 1 is a top rear side perspective view of the quick-release retaining device of the invention in a closed and locked condition.
Figure 2:
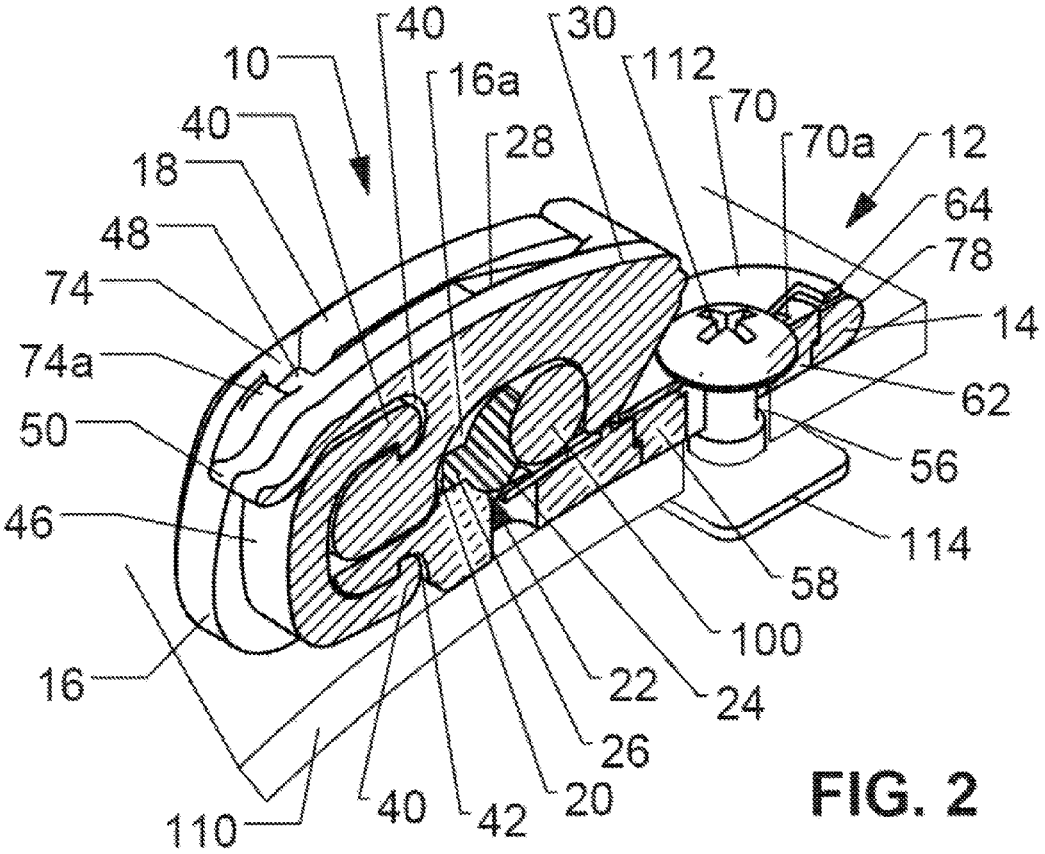
FIG. 2 is a sectional view through the approximate middle of the device in the closed condition with a faceguard wire locked in the device and the device attached to a helmet shell for use.

Referring now to the drawings, FIGS. 1 and 2 illustrate a quick-release faceguard retaining device 10 of the invention, for holding a faceguard wire 100 to the shell 110 of a helmet, using a screw 112 threaded to a T-nut 114, extending through a base of the device.

With reference to FIGS. 1 to 5, base 12 has an underlying portion 14 that is continuous with a curved portion 16 and an overlying portion 18. The overlying portion 18 consists of two parallel arms which partially extend over the length of the underlying portion 14. The underside of the base 12 has a concave curvature to accommodate the curvature of a typical sports helmet shell 110.

The curved portion 16 defines a faceguard wire receiving groove 16*a* which contains a shock stabilizer 22 of rubber or other firm but resilient material. As seen in FIG. 2, the shock stabilizer 22 has a main portion 24 and a backward-projecting legs 26. The shock stabilizer 22 is secured to the base 12 by sliding the backward-projecting legs 26 into a receiving groove 20 of the base 12, shown best in FIG. 5. The main portion 24 of the shock stabilizer 22 is forwardly concave so as to receive and secure the faceguard wire 100 which is pressed against this concave surface to compress the stabilizer 22 slightly when the device is in its closed and locked condition illustrated in FIGS. 2 and 3.

In a typical embodiment, the shock stabilizer 22 is made of a softer material than the material from which the base 12 is made. The relative softness of the shock stabilizer 22 allows for some give, in the event of impact against the faceguard from an axially-opposed force, such as from another helmet or the ground. Preferably, the shock stabilizer 22 is made of rubber as noted, and the base 12 is made of a hard polycarbonate. These are non-limiting examples, as the base 12 and shock stabilizer 22 may each be made of any convenient material such that there is a differential in hardness between them.

As seen in FIG. 1, the retaining device 10 also has a T-shaped top latch 28 secured in a hinged manner to the base 12. Specifically, lateral projections or trunnions 72 on the latch 28 that are visible in FIGS. 3 and 4, sit in the lower end or bottom of vertically elongated grooves 74, in opposite inside surfaces of the overlying portions 18 of the base 12.

The latch 28 has a front hooked part 30. In the locked condition, the hooked part 30 presses the faceguard wire 100 down against the underlying portion 14 of the base 12 and back against the shock stabilizer 22. Thus, when the hooked part 30 is in its down, closed and locked position, the latch 28, the base 12, and the shock stabilizer 22 define a receiving aperture for enclosing the wire 100 of a faceguard as shown in FIG. 2.

In a preferred embodiment, this receiving aperture that includes the faceguard wire receiving groove 16*a*, has an arcuate cross-section. However, it is within the scope of the invention for the receiving aperture to have a cross section of any convenient shape, in accordance with the profile of the particular faceguard wire to be accommodated.

The base 12 and the latch 28 are further secured by a substantiality C-shaped clip 46. As shown in FIG. 2, the clip 46 has curved parts 40 at either end, so that it may be secured within a clip-receiving groove 42 at the rear center of the base 12 between the two parts of the curved portion 16, at one end and within a clip-receiving groove of the latch 28 at the other end. The clip 46 exerts constant closing forces on the latch 28 and the base 12, so that the retaining device 10 is biased to the closed condition.

Figure 3:
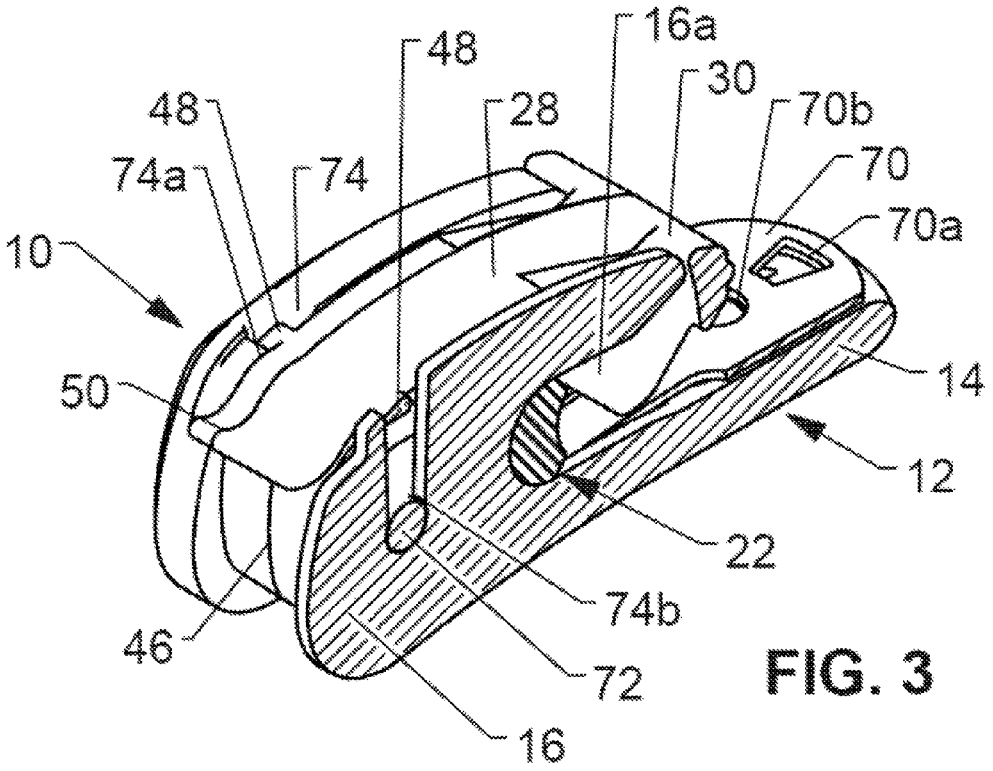
FIG. 3 is a sectional view through one side wall of the base of the device in the closed condition to show the locking mechanism of the device.
Figure 4:
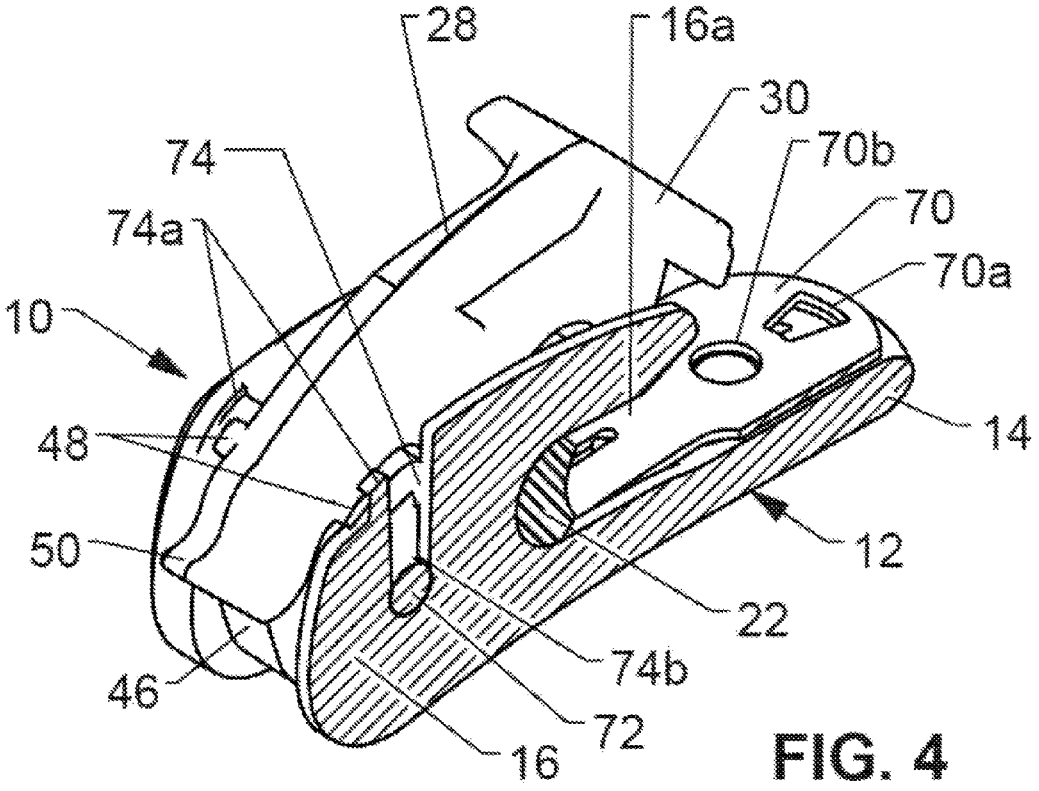
FIG. 4 is a view similar to FIG. 3, of the device in an open and unlocked condition.

In order to lock the latch 28 in its closed condition, and as shown in FIGS. 3 and 4, latch 28 has a pair of laterally extending nubs or ears 48, which, in the closed position of the latch shown in FIG. 3, sit inside the grooves 74, near the tops of these grooves. In this position, the ears or nubs 48 prevent the latch 28 from pivoting upwardly toward its open position because any such upward force is resisted by the nubs 48 pressing back against rear walls 74*a* of the grooves 74. In this way, the device 10 will not open when, for example, a pulling force is exerted on the faceguard, e.g. during a play.

In order to unlock the latch 28, so that it can pivot on its trunnions 72 to its open condition shown in FIG. 4, one may use a thumb to engage under a rearwardly extending wing 50 of the latch, and a forefinger to engage under the hooked part 30 of the latch, to lift the latch 28 vertically upwardly against the bias of clip 46, until the nubs 48 clear the tops of rear walls 74*a* so that the latch can then be pivoted upwardly. As the latch pivots upwardly the nubs 48 move rearwardly and, when the latch is release, come to rest behind the walls 74*a* as shown in FIG. 4.

Figure 5:
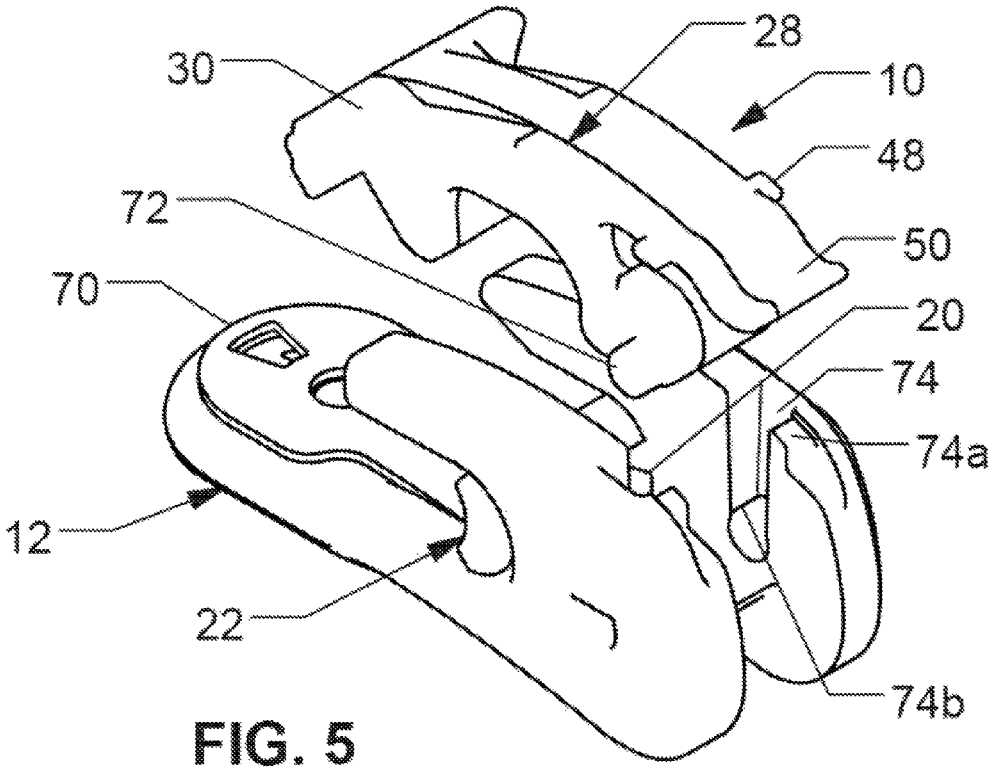
FIG. 5 is an exploded view of the base and latch of the device.

To help retain the trunnions 72 in the bottom of their respective grooves 74, and as best seen in FIG. 5, each groove 74 has a slight circular enlargement at its bottom, starting at location 74*b*. Above this location 74*b*, each groove 74 is slightly narrower than the diameter of its trunnion 72. In this way, when the latch is pulled upwardly to unlock it, each trunnion 72 is pulled up into the narrower part of its groove 74. Due to the resilience of the plastic materials used for the base and latch, this small miss-match of dimensions can be accommodated. Once the latch is pivoted open, it is then pushed or release down into the position of FIG. 4. This results in the trunnions being pushed down past the locations 74*b* and causing a snapping effect as the trunnions are seated at the bottom of each groove, to give the user a clear signal that the latch is open and properly in place. As similar snapping effect occurs when the latch is moved to its closed and locked condition.

A faceguard wire can then be removed from or insert into the receiving groove 16*a*. To then close the latch 28, it is again lifted with the aide of wing 50 and hooked part 30, and pivoted downwardly to return to the closed and locked condition of FIG. 3.

As noted, the clip 46 exerts constant closing forces on the latch 28 and the base 12, which biases the retaining device 10 in the closed condition.

Typical embodiments of the invention also include a grommet 58 located in an opening 78 in the base 12. The retaining device 10 may be secured to a sports helmet by the screw 112 passed through an opening 56 in the grommet 58. The screw 112 is passed further into the T-nut 114 inside the sports helmet shell 110. The screw 112 and T-nut 114 fix the base 12 to the helmet shell. In certain embodiments, there is a spacer 60 located in the opening 56 of the grommet 58.

In typical embodiments, the grommet 58 is shock-absorbing disc having a two-tiered structure, including a platform base 62 and a raised surface 64, as best understood with reference to FIG. 2. The raised surface 64 is composed of two opposed crescents arranged to accommodate curvature of the spacer 60. The raised surface 64 is disposed in surrounding relation to the opening 56.

As best observed in FIG. 2, the raised surfaces 64 protrudes slightly above the surface of the base 12 and extend into corresponding openings 70*a* of a retaining plate 70 made of spring steel or other strong material and also visible in FIGS. 3, 4 and 5. When the screw 112 is moved into the opening 56 of base 12, it also passes through an opening 70*b* in plate 70. When securely threaded to T-nut 114, the screw 112 also pressed the plate 70 onto the raised surfaces 64, keeping the plate centered on the base and pressing the plate toward the helmet shell 110. In this way the underlying portion 14 of the base 12 is kept from being permanently bent outwardly away from the helmet shell 110, e.g. due to a strong pull on the faceguard, by virtue of the spring steel plate 70 which will resist such force and, in any case, return the base 12 to its correct location, firmly against the helmet shell, after a pull.

In preferred embodiments, the grommet 58 is composed of SURLYN, but other materials may be used such as any synthetic or natural material that may be shaped when soft and then hardened, including many types of resins, resinoids, and polymers (Nylon, Polyester, Acetal, Polypropylene). These may be used, alone or in combination.

In preferred embodiments, the base 12 has a width of about 0.800 inches to 1.000 inches, and most preferably has a width of about 0.890 inches in the region which houses the grommet 58 and about 0.830 inches in the region where the hinged connection is formed with the latch 28. The base 12 has a preferred height in the range of about 0.850 inches to about 1.050 inches, and most preferably has a height of about 0.934 inches. The base 12 has a preferred length of about 1.300 inches to 3.300 inches, and most preferably a length of about 2.270 inches. The distance from the edge of the overlying portion 18 of the base 12 downward to the underlying portion 14 is preferably in the range of about 0.200 inches to about 0.400 inches, and most preferably about 0.320 inches. The distance between the parallel arms 34 of the overlying portion 18 is preferably in the range of about 0.300 inches to about 0.500 inches, and most preferably about 0.390 inches.

The latch 28 has a preferred height in the range of about 0.450 inches to 0.650 inches, and most preferably 0.560 inches. The latch 28 has a preferred length in the range of about 1.250 inches to about 1.450 inches and most preferably a length of about 1.360 inches. The width of the latch 28 from one end of the hooked part 30 to the other is preferably in the range of about 0.700 inches to 0.900 inches and most preferably about 0.790 inches. The width of the latch 28 from the ends of lateral projections 72 is preferably about 0.500 inches to 0.700 inches, and most preferably 0.580 inches. The width of the latch in the area between the hooked part 30 and the lateral projections 72 is preferably about 0.300 inches to 0.500 inches and most preferably about 0.380 inches.

The C-shaped clip 46 has a thickness preferably in the range of about 0.050 inches to 0.250 inches and most preferably about 0.140 inches. The C-shaped clip 46 has a width preferably of about 0.275 inches to 0.475 inches and most preferably about 0.375 inches. The C-shaped clip 46 preferably has a height of about 0.550 inches to about 0.750 inches and most preferably about 0.670 inches.

The shock stabilizer 22 preferably has a length, measured from the edge of the backward-projecting legs 26 to the edge of the main portion 24 of about 0.200 inches to about 0.400 inches and most preferably about 0.310 inches.

The grommet 58 has a diameter of about 0.300 inches to about 0.500 inches, and preferably about 0.380 inches. The grommet opening 56 preferably has a diameter in the range of about 0.200 inches to 0.400 inches, and most preferably about 0.316 inches. The height of the platform base 62 is preferably about 0.050 inches to about 0.150 inches, and most preferably about 0.100 inches. The length of the platform base 62 is preferably about 0.600 inches to 0.800 inches and most preferably 0.710 inches. The height from the top of the raised surface to the bottom of the platform base 62 is preferably about 0.100 inches to 0.300 inches, and most preferably about 0.188 inches.

The spacer 60 preferably has a diameter of about 0.330 inches to about 0.300 inches and most preferably about 0.313 inches. The diameter of the opening of the spacer is preferably about 0.170 inches to 0.160 inches and most preferably 0.166 inches.

While a specific embodiment of the invention has been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention. Thus, all the features of all the embodiments disclosed herein are interchangeable so that any element of any embodiment may be applied to any of the embodiments taught herein.

What is claimed is:

1. A quick-release helmet faceguard retaining device, comprising:

a base defining a shock stabilizer receiving groove for receiving a wire of a faceguard, a pair of spaced apart grooves, and an underlying portion for extending along a surface of a shell of a helmet to which a faceguard is to be attached;

a latch pivotally mounted to the base, the latch comprising a front hooked part, a pair of nubs extending outwardly from the latch near a rear end of the latch, a pair of trunnions extending outwardly from the latch near the rear end of the latch and below the nubs, the trunnions being mounted for pivoting in the apart grooves, near lower ends of the apart grooves, and the nubs extending in the apart grooves near upper ends of the apart grooves when the latch is in a closed and locked condition to prevent the latch from pivoting;

a clip made of resilient material and engaged to the latch and to the base for biasing the latch to pivot to the closed and locked condition, the clip being adapted to exert closing forces on the latch and the base, so that the retaining device is biased toward the closed condition;

a shock stabilizer located in the shock stabilizer receiving groove of the base, the base, the shock stabilizer and the latch being adapted to cooperatively define a receiving aperture in a closed condition for securing a faceguard wire in the device;

a plate extending over at least part of the underlying portion; and a fastener for fastening the plate and the base to the helmet shell so that the plate resists permanent bending of the underlying portion away from the helmet shell;

the latch being lifted away from the underlying portion against the bias of the clip to lift the nubs from the grooves and allow the latch to pivot upwardly into an open condition for receiving and for releasing the faceguard wire.

2. The quick-release helmet faceguard retaining device of claim 1, wherein the shock stabilizer is of a softer material than the base.

3. The quick-release helmet faceguard retaining device of claim 1, wherein the shock stabilizer comprises rubber.

4. The quick-release helmet faceguard retaining device of claim 1, wherein the base comprises a thermoplastic polymer.

5. The quick-release helmet faceguard retaining device of claim 1, wherein the base is made of a hard polycarbonate.

6. The quick-release helmet faceguard retaining device of claim 1, wherein the base has a grommet receiving opening, the device including a grommet located in the opening of the base, the grommet defining a grommet opening for receiving the fastener.

7. The quick-release helmet faceguard retaining device of claim 1, wherein the base has a grommet receiving opening, the device including a grommet located in the opening of the base, the grommet defining a grommet opening for receiving the fastener, the grommet being a shock-absorbing disc.

8. The quick-release helmet faceguard retaining device of claim 1, wherein the base has a grommet receiving opening, the device including a grommet located in the opening of the base, the grommet defining a grommet opening for receiving the fastener, the grommet comprising SURLYN.

9. The quick-release helmet faceguard retaining device of claim 1, wherein the base has a grommet receiving opening, the device including a grommet located in the opening of the base, the grommet defining a grommet opening for receiving the fastener, the grommet comprising the shock absorbing disc with a platform and a raised surface, the plate having a opening for receiving the raised surface.

10. The quick-release helmet faceguard retaining device of claim 1, wherein the base has a grommet receiving opening, the device including a grommet located in the opening of the base, the grommet defining a grommet opening for receiving the fastener, the grommet comprising the shock absorbing disc with a platform and a raised surface, the plate having a opening for receiving the raised surface, the raised surface comprising two opposed crescents arranged to accommodate a curvature of the grommet opening, the plate including an opening for each crescent.

11. The quick-release helmet faceguard retaining device of claim 1, wherein the base has a grommet receiving opening, the device including a grommet located in the opening of the base, the grommet defining a grommet opening for receiving the fastener, the fastener comprising a screw and T-nut.

12. The quick-release helmet faceguard retaining device of claim 1, wherein the base has a grommet receiving opening, the device including a grommet located in the opening of the base, the grommet defining a grommet opening, and a spacer located in the grommet opening for receiving the fastener.

13. The quick-release helmet faceguard retaining device of claim 1, wherein the base has a concave curvature along an underside of the underlying portion for following a contour of the helmet shell.

14. The quick-release helmet faceguard retaining device of claim 1, wherein the latch includes a rearwardly extending wing for facilitating lifting of the latch vertically.

15. The quick-release helmet faceguard retaining device of claim 1, wherein each groove includes a larger diameter bottom end and narrower upper portion for releasably retaining the trunnions in the bottom ends of the grooves.

16. A quick-release helmet faceguard retaining device, comprising:

a base defining a shock stabilizer receiving groove for receiving a wire of a faceguard, a pair of spaced apart grooves, and an underlying portion for extending along a surface of a shell of a helmet to which the faceguard is to be attached;

a latch pivotally mounted to the base, the latch comprising a hooked part near a forward end of the latch, a pair of trunnions extending outwardly from the latch near the rear end of the latch, the trunnions being mounted for pivoting in the apart grooves, near lower ends of the apart grooves, into a closed condition;

a clip engaged to the latch and to the base for biasing the latch to pivot to the closed condition, the clip being adapted to exert closing forces on the latch and the base, so that the retaining device is biased to the closed condition;

a shock stabilizer located in the shock stabilizer receiving groove of the base, the base, the shock stabilizer and the latch being adapted to cooperatively define a receiving aperture in a closed condition for securing the faceguard wire in the device;

a plate extending over at least part of the underlying portion; and a fastener for fastening the plate and the base to the helmet shell so that the plate resists permanent bending of the underlying portion away from the helmet shell.

17. The quick-release helmet faceguard retaining device of claim 16, wherein the latch includes a pair of nubs extending outwardly from the latch near a rear end of the latch, the nubs extending in the apart grooves near upper ends of the apart grooves when the latch is in the closed condition to prevent the latch from pivoting into an open condition.

18. The quick-release helmet faceguard retaining device of claim 16, wherein the base has a grommet receiving opening, the device including a grommet located in the opening of the base, the grommet defining a grommet opening for receiving the fastener, the grommet comprising the shock absorbing disc with a platform and a raised surface, the plate having a opening for receiving the raised surface.

19. A quick-release helmet faceguard retaining device, comprising:

a base defining a shock stabilizer receiving groove for receiving a wire of a faceguard, a pair of spaced apart grooves, and an underlying portion for extending along a surface of a shell of a helmet to which the faceguard is to be attached;

a latch pivotally mounted to the base, the latch comprising a hooked part near a forward end of the latch, a pair of nubs extending outwardly from the latch near a rear end of the latch, a pair of trunnions extending outwardly from the latch near the rear end of the latch, the trunnions being mounted for pivoting in the apart grooves, near lower ends of the apart grooves, and the nubs extending in the apart grooves near upper ends of the apart grooves when the latch is in a closed and locked condition to prevent the latch from pivoting;

a clip made of resilient material and engaged to the latch and to the base for biasing the latch to pivot to the closed and locked condition, the clip being adapted to exert closing forces on the latch and the base, so that the retaining device is biased to the closed condition;

a shock stabilizer located in the shock stabilizer receiving groove of the base, the base, the shock stabilizer and the latch being adapted to cooperatively define a receiving aperture in a closed condition for securing the faceguard wire in the device; and a fastener for fastening the base to the helmet shell;

the latch being liftable away from the underlying portion against the bias of the clip to lift the nubs from the grooves and allow the latch to pivot upwardly into an open condition for receiving and releasing the faceguard wire.

20. The quick-release helmet faceguard retaining device of claim 19, including a plate extending over at least part of the underlying portion, the fastener fastening the plate and the base to the helmet shell so that the plate resists permanent bending of the underlying portion away from the helmet shell.

* * * * *